United States Patent [19]

Mugnier

[11] Patent Number: 4,995,319

[45] Date of Patent: Feb. 26, 1991

[54] SHEAVE TRAIN ASSEMBLY FOR CABLE TRANSPORTATION SYSTEMS

[75] Inventor: Jean-Francois Mugnier, Grand Junction, Colo.

[73] Assignee: Poma of America, Inc., Grand Junction, Colo.

[21] Appl. No.: 364,651

[22] Filed: Jun. 9, 1989

[51] Int. Cl.[5] ..... B61B 7/00; B61B 11/00

[52] U.S. Cl. ..... 104/112; 104/173.2

[58] Field of Search ..... 104/112, 115, 117, 173.1, 104/173.2, 180, 204; 254/277

[56] References Cited

U.S. PATENT DOCUMENTS

| | | | |
|---|---|---|---|
| 4,760,992 | 8/1988 | Peppel et al. | 254/277 |
| 4,777,886 | 10/1988 | Tarassoff | 104/180 |
| 4,796,862 | 1/1989 | Peppel | 254/277 |

*Primary Examiner*—Joseph F. Peters, Jr.
*Assistant Examiner*—Virna Lissi Mojica
*Attorney, Agent, or Firm*—Klaas & Law

[57] ABSTRACT

A sheave support system for supporting the sheaves of a multiple sheave assembly relative to a support structure, such as a ski lift tower, which comprises at least two sheave members rotatably mounted on the sheave assembly in spaced parallel relationship for supporting the ski lift cable; at least one main support shaft for movably supporting the sheave assembly relative to the ski lift tower; at least two intermediate support arms mounted on the main support shaft; and at least two intermediate support shafts mounted on opposite ends of the intermediate support arm for rotatably supporting the sheave. The support shaft means comprises a support shaft, a hub member mounted circumjacent the support shaft, and an elastic bushing device mounted between the support shaft and the hub member for connecting the hub member to the shaft member while enabling limited relative rotative movement therebetween of less than approximately 15 degrees and also limiting transmission of vibration therebetween.

16 Claims, 10 Drawing Sheets

SHEAVE TRAIN ASSEMBLY FOR CABLE TRANSPORTATION SYSTEMS

This invention relates to cable transportation systems, and more particularly to a sheave train assembly for supporting the haul cable of a cable transportation system, such as used to transport skiers by chair lift, gondola or the like.

BACKGROUND & SUMMARY OF INVENTION

Various cable transportation systems, such as chair lifts, gondola lifts, etc. are used to transport skiers from the bottom to the top of a ski run. Such lift apparatus typically comprises spaced tower structures having sheave train assemblies mounted thereon with multiple sheave units for engaging a movable endless haul cable which is driven by suitable drive means at the top and/or bottom of the ski lift. Some sheave units supportively engage the bottom of the cable and other sheave units may depressively engage the top of the cable. Passenger carrying devices such as chairs, gondolas and the like are suitably connected to the haul cable for movement between the bottom and top of the ski run. Such cable transportation systems are often operated in extreme low temperature weather conditions.

In general, the prior art sheave train assemblies comprise a plurality of rotatable sheave members which are rotatably mounted on associated support shaft members by bearing devices with associated lubrication apparatus. Typical sheave train assemblies may comprise 4, 6 or 8 sheave members. Pairs of the sheave members and sheave support shaft members are mounted on opposite ends of sheave support rocker arm apparatus pivotally movable about a central pivot axis. Pairs of the sheave support rocker arm apparatus are pivotally mounted on opposite ends of intermediate pivotal rocker arms which, in turn, may be mounted on a central main pivotal rocker arm. Each rocker arm is pivotally supported by central axle apparatus including grease-type lubrication apparatus. The central axle apparatus comprises a hub member rotatably mounted on a shaft member by axially spaced sleeve-type metallic bearing members with an annular grease chamber therebetween. In order to lubricate the axle assemblies, maintenance personnel must climb the lift towers which is a difficult, laborious procedure. In use, the rocker arm members ordinarily are subject to only very limited pivotal movement of no more than about 10° to 20°. Thus, the lubrication may not be uniformly applied to the entire circumference of the parts subject to relative rotation. Other problems with current apparatus are vibrations and noise created by relative movement between various parts and lack of cushioning between such parts.

A primary object of the present invention is to provide sheave train assembly which requires minimum lubrication with increased durability and decreased wear.

Another object of the invention is to also provide cushioning and vibration dampening means.

Another object of the invention is to reduce cost of construction and maintenance and repair.

In general, the objects of the present invention have been achieved by use of an elastomeric bushing means to couple relatively movable parts without use of lubricant. Each elastomeric bushing means comprise an elastomeric sleeve member mounted in compression in an annular chamber between an outer metallic sleeve member and an inner metallic sleeve member in a manner which enables limited relative arcuate torsional movement therebetween while also absorbing vibration and shock loads and reducing operational noise.

BRIEF DESCRIPTION OF THE DRAWINGS

Illustrative and presently preferred embodiments of the invention are hereinafter described and shown in the accompanying drawings wherein.

DETAILED DESCRIPTION

Figure 1:
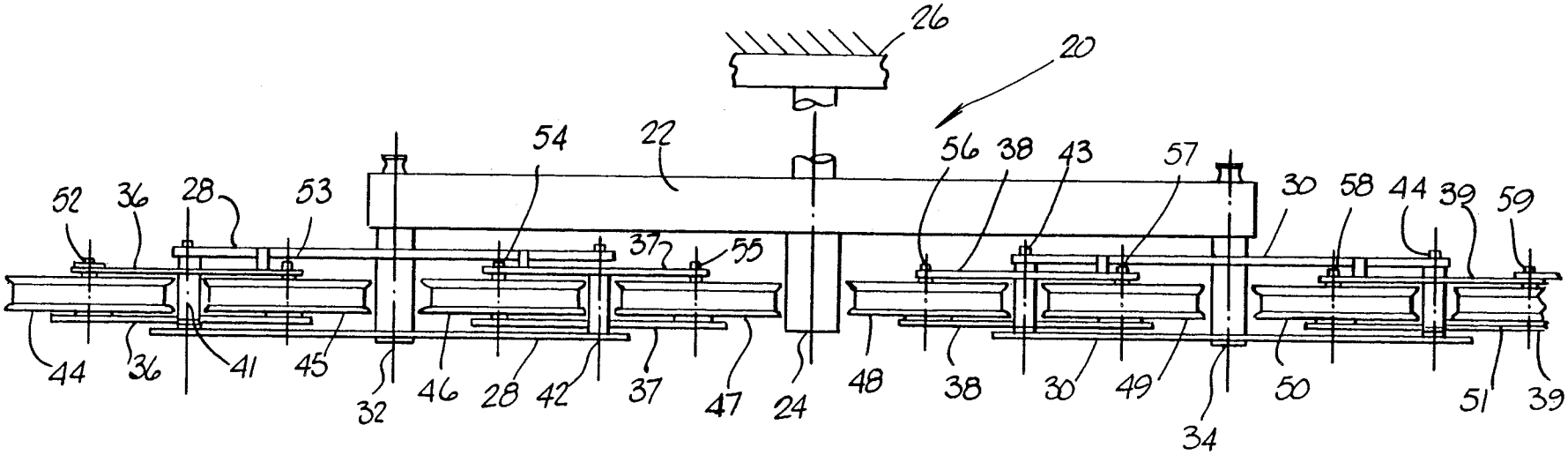
FIG. 1 is a schematic plan view of a sheave train assembly.

FIG. 1 shows a conventional sheave train assembly 20 comprising a main central rocker arm means 22 pivotally supported on a main axle means 24 which is fixedly mounted on tower support structure 26. Intermediate rocker arm means 28, 30 are pivotally supported on intermediate axle means 32, 34 mounted on the opposite end portions of central rocker arm means 22. Sheave support rocker arm means 36, 37, 38, 39 (partially shown) are pivotally supported on axle means 40, 41, 42, 43, mounted on opposite end portions of intermediate rocker arm means 28, 30. Sheave means 44, 45, 46, 47, 48, 49, 50, 51 (partially shown) are rotatably mounted on shaft means 52, 53, 54, 55, 56, 57, 58, 59 fixed on opposite ends of sheave support arm means 36–39. Each of the sheave means is rotatable about its associated shaft means 52–59. Each of the pair of sheave means (eg. 44, 45) on each sheave support rocker arm means (eg. 36) are independently oppositely movable about the associated axle means (eg. 41). Each set of the four sheave means 44, 45, 46, 47 and 48, 49, 50, 51 on opposite ends of intermediate rocker arm means 28 and 30 are oppositely movable about the associated axle means 32, 34 which are also oppositely movable about central main axle means 24.

Figure 2:
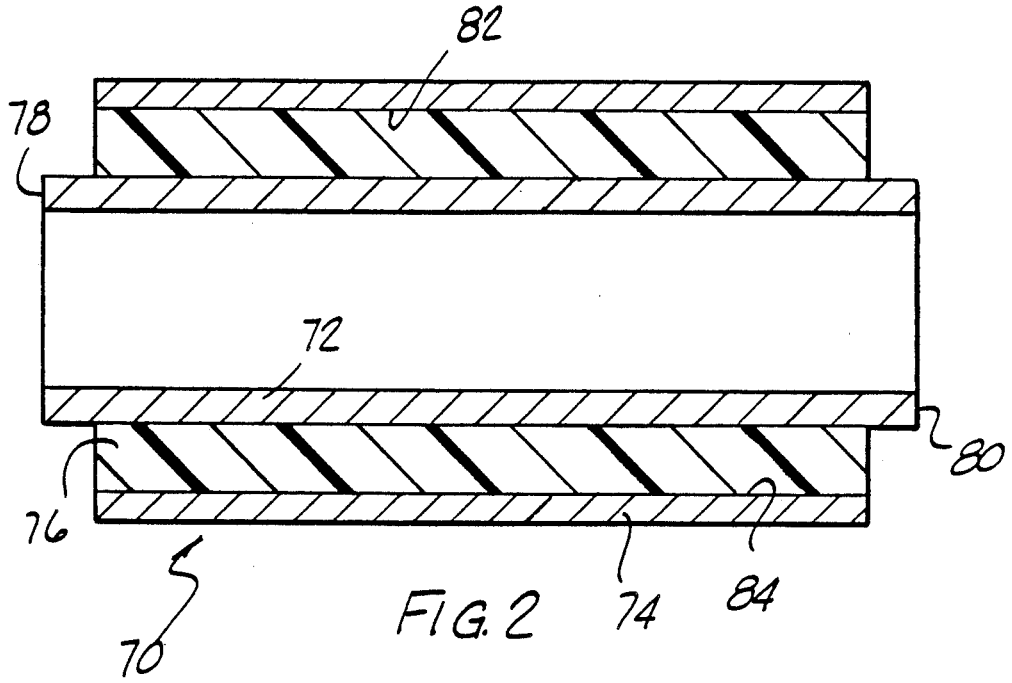
FIG. 2 is a longitudinal cross-sectional view of a bushing for use with the sheave train assembly.

FIG. 2 shows an elastomeric bushing means 70 which is used in the present invention to mount the rocker arm means on the associated rocker arm axle means and to mount the sheave means on the associate sheave shaft means. In general, the bushing means comprises an annular inner rigid metallic sleeve member 72, an annular outer metallic rigid sleeve member 74, and an intermediate annular connecting member 76 made of elastomeric material. Inner sleeve member 72 is longer than outer sleeve member 74 to provide axially offset abutment surfaces 78, 80 whereby the inner sleeve member may be fixedly held relative to a support member to enable the outer sleeve member to turn relative to the inner sleeve member. The intermediate elastomeric sleeve member 76 is compressibly fixedly mounted on and retained between the surfaces 82, 84 and enables relative resilient displacement between the inner and outer sleeve members 72, 74 under torsional load. Bushing units of this type are of conventional design and commercially available from various sources such as from Metalastik Co. and Paulstra. Technical specifications are attached hereto and incorporated hereby by reference as Exhibit A and Exhibit B.

Presently commercially available bushing units of this type are available in various sizes with various compositions of elastomeric material which provide varying characteristics. Torsional displacement characteristics may vary from 8° to 35° degrees of relative angular deflection. For use in connection with the present invention angular deflection of 7 to 15 degrees should be sufficient. Radial load characteristics of available bushing units vary from a rate of 1600 to 350,000 or more pounds/inch; maximum load of 72 to 19,000 pounds; and maximum deflection of 0.018 to 0.075 inch or more. Type maximum angle of axial tilt varies from 1 degree to approximately 7°. In use in the present invention, a minimum angle of axial tilt is desired to maintain a substantially steady state parallel axes of rotation. In the present invention, the preferred characteristics of the bushing units are torsion twist angles of 7° to 15° and axial tilt angles of no more than 1° to 2°. The bushing unit should provide only limited relative longitudinal tiling movement of the outer sleeve member relative to the inner sleeve member about a central pivotal axis at an angle of less than 3°. The intermediate elastomeric material enables the desired amount of relative movement, while also dampening vibration and sound, and also eliminates the need for lubrication.

Figure 3:
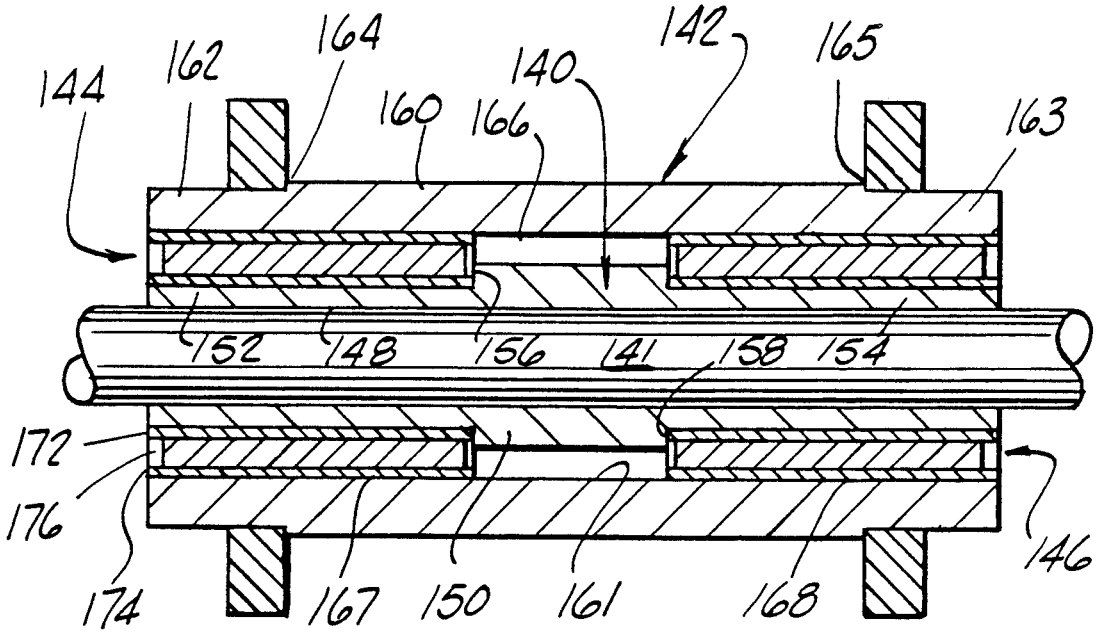
FIG. 3 is a cross-sectional view of one form of a bearing assembly for rotatably supporting a pulley on a support shaft.

FIG. 3 shows one form of a hub assembly comprising an inner sleeve means 140 mounted on a bolt member 141; an outer support sleeve means 142; and a pair of oppositely spaced elongated elastomeric bushing units 144, 146. Inner sleeve means 140 comprises a rigid metallic sleeve member with a central bore 148, a central enlarged diameter hub portion 150, and elongated reduced diameter end portions 152, 154. Hub portion 150 provides annular radially extending shoulders 156, 158. Outer support sleeve means 142 comprises a rigid sleeve member 160 made of metallic material and having a central bore 161 and reduced diameter end portions 162, 163 providing annular shoulders 164, 165. The diameter of bore 161 is larger than the outside diameter of central portion 150 to provide an annular chamber 166 therebetween, and larger than the outside diameter of end portions 152, 154 to provide elongated annular bushing chamber 167, 168 therebetween. Each of the bushing means 144, 146 comprise a rigid inner sleeve member 172 fixed to end portions 152, 154, a rigid outer sleeve member 174 fixed to member 160, and an elastomeric member 176.

Figure 4:
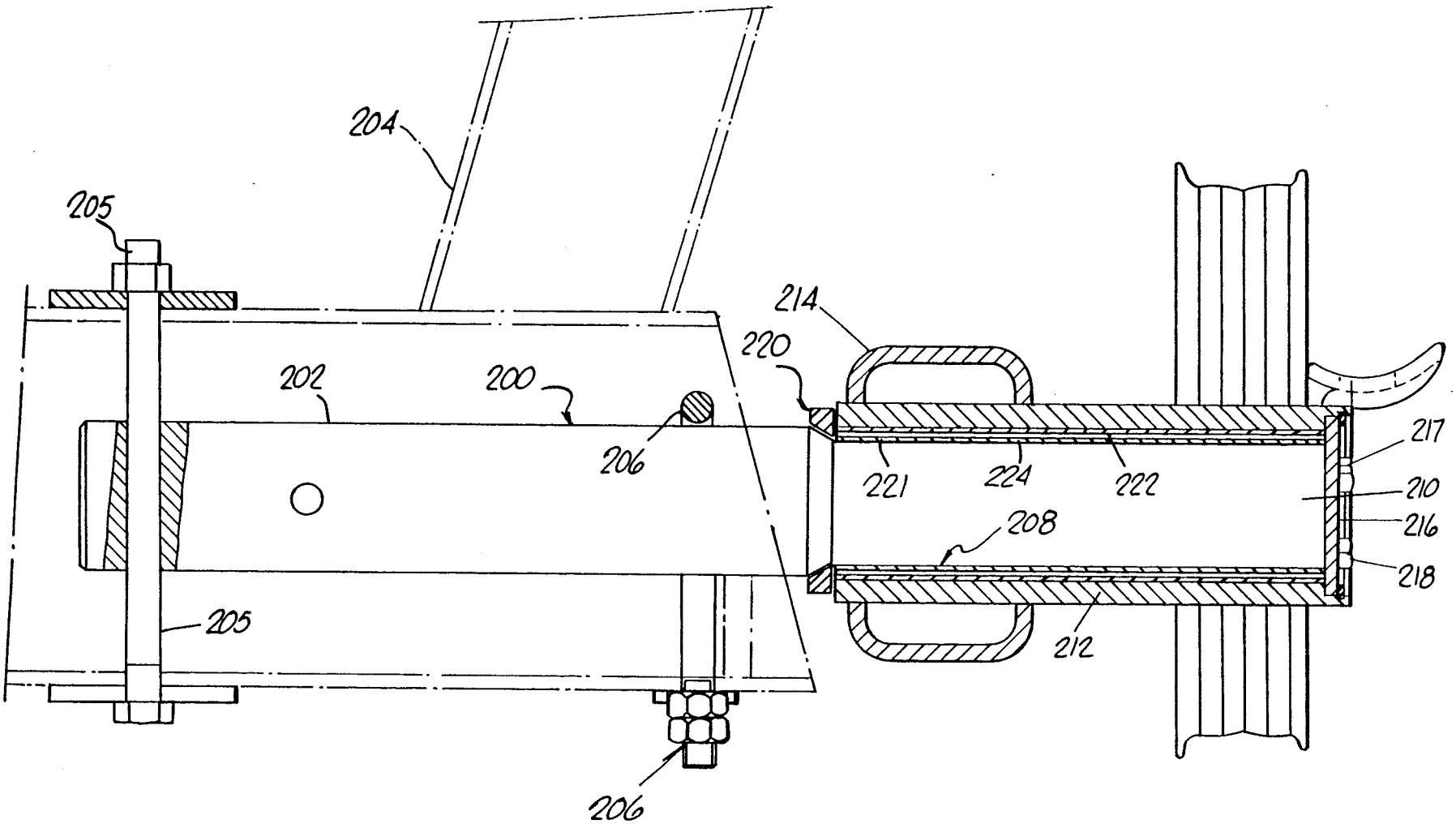
FIG. 4 shows a main rocker arm hub assembly.

FIG. 4 shows a main rocker arm hub assembly comprising a shaft member 200 having an end portion 202 fixedly mounted in the tower structure 204 by suitable bolt devices 205, 206. A bushing unit 208 is mounted between shaft end portion 210 and a support sleeve member 212 fixedly connected to main rocker arm member 214. An end plate 216 and bolt devices 217, 218 retain the bushing unit 208 and the support sleeve 212 on shaft portion 210 with inner bushing sleeve member 221 held against a collar device 220. Outer bushing sleeve member 222 is fixedly mounted in support sleeve member 212. Elastomeric member 224 connects the inner and outer sleeve members 221, 222 as previously described.

Figure 5B:
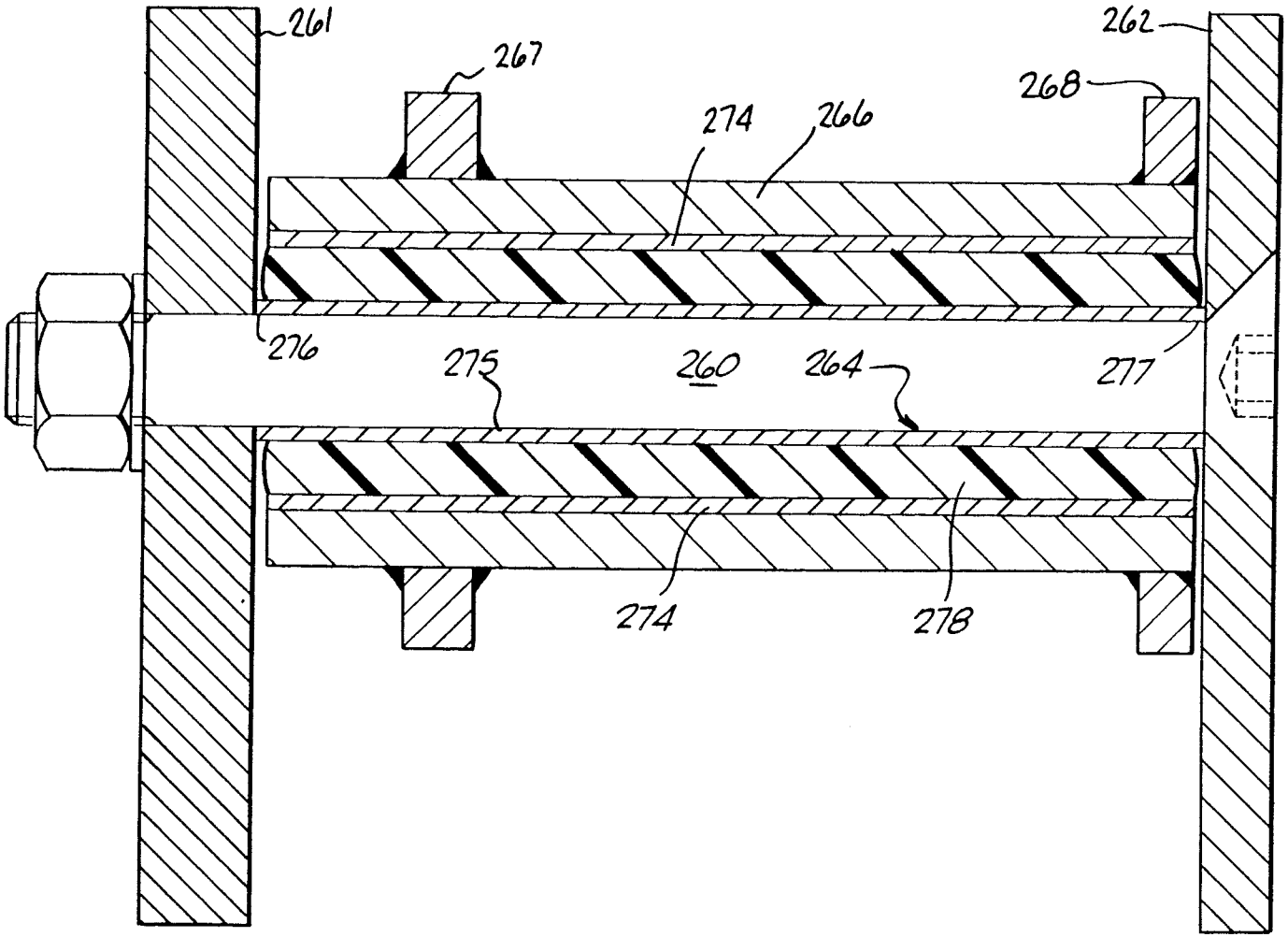
FIG. 5B is a cross-sectional view of an intermediate rocker arm assembly.
Figure 5:
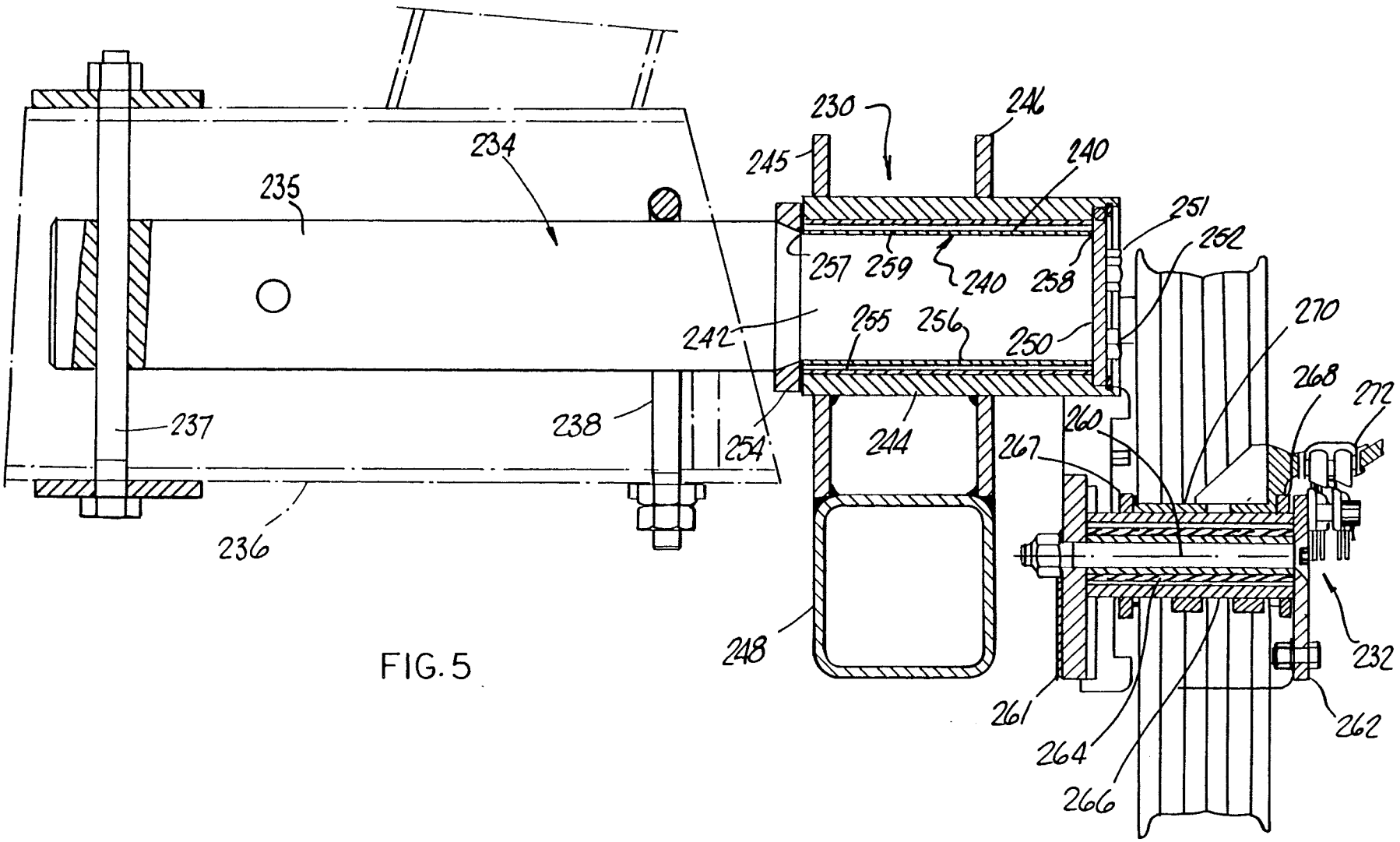
FIG. 5 shows another main rocker arm hub assembly and an intermediate rocker arm hub assembly.
Figure 5A:
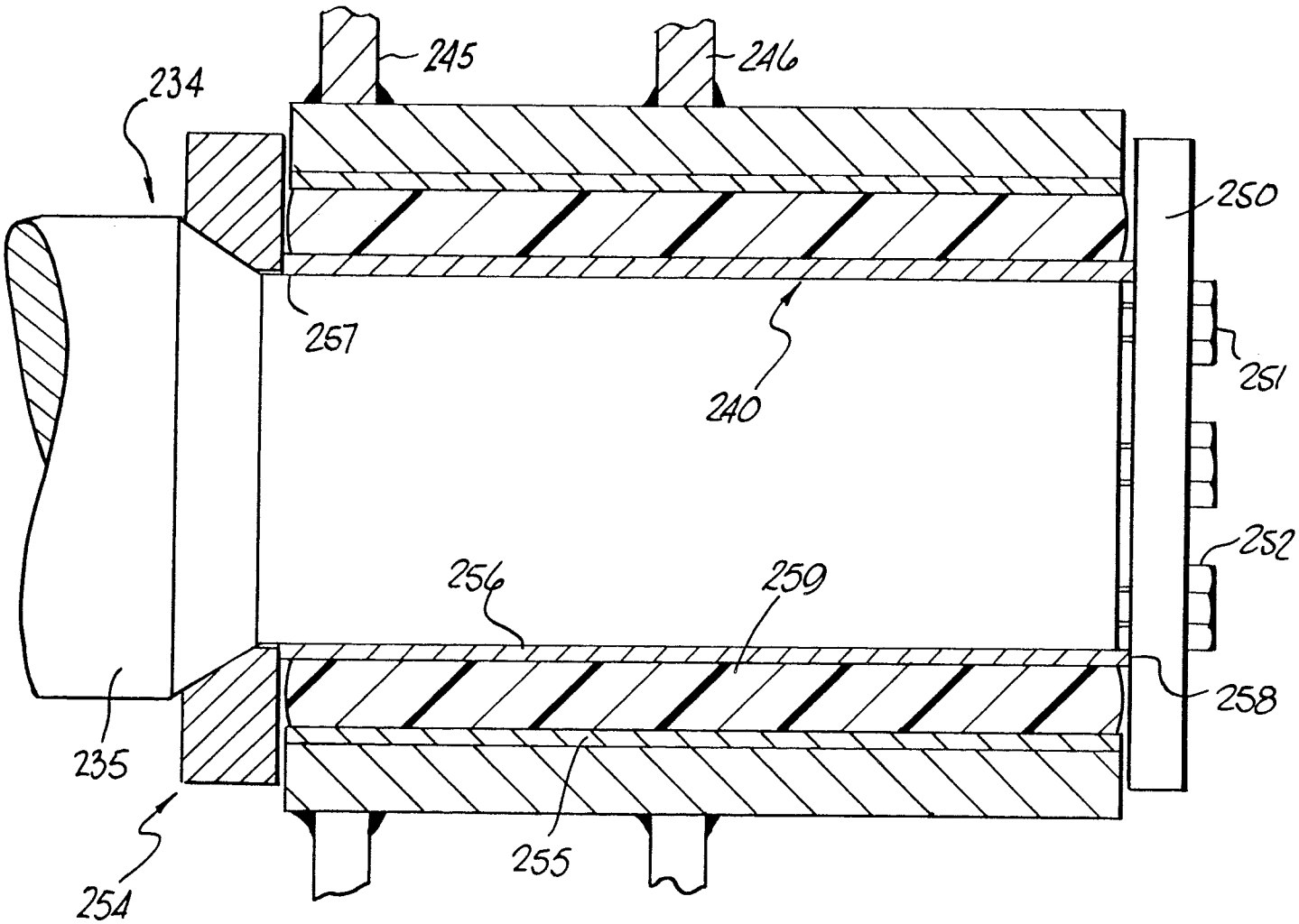
FIG. 5A is a cross-sectional view of a main rocker arm hub assembly.

FIG. 5 shows another main rocker arm hub assembly 230 and an intermediate rocker arm sub-assembly 232. The rocker arm hub assembly 230 comprises a shaft member 234 having an end portion 235 fixedly mounted on tower structure 236 by suitable bolt devices 237, 238. A bushing unit 240 is mounted on shaft end portion 242 and supports a sleeve member 244 fixedly connected to plate members 245, 246 of main rocker arm 248. Retainer plate member 250 and bolt devices 251, 252 retain the bushing unit 240 and the sleeve member 244 on shaft end portion 242 against collar means 254. As shown in FIG. 5A, bushing unit 240 comprises an outer sleeve member 255 fixed in sleeve member 244, an inner sleeve member 256 with opposite end portions 257, 258 fixedly abuttingly engaging plate 250 and collar means 254, and an elastomeric member 259.

The intermediate rocker arm hub assembly 232 comprises a bolt member 260 extending between and fixed to side plate members 261, 262 of the intermediate rocker arm assembly. A resilient coupling bushing unit 264 is mounted on bolt member 260 and supports a sleeve member 266 with end flanges 267, 268. A hub member 270 is mounted on sleeve member 266 and has a cable derail flange portion 272. As shown in FIG. 5B, bushing unit 264 comprises an outer sleeve member 274 fixed in sleeve member 266, an inner sleeve member 275 with opposite end portions 276, 277 fixedly abutting side plate members 261, 262 and an elastomeric intermediate connecting member 278.

Figure 6:
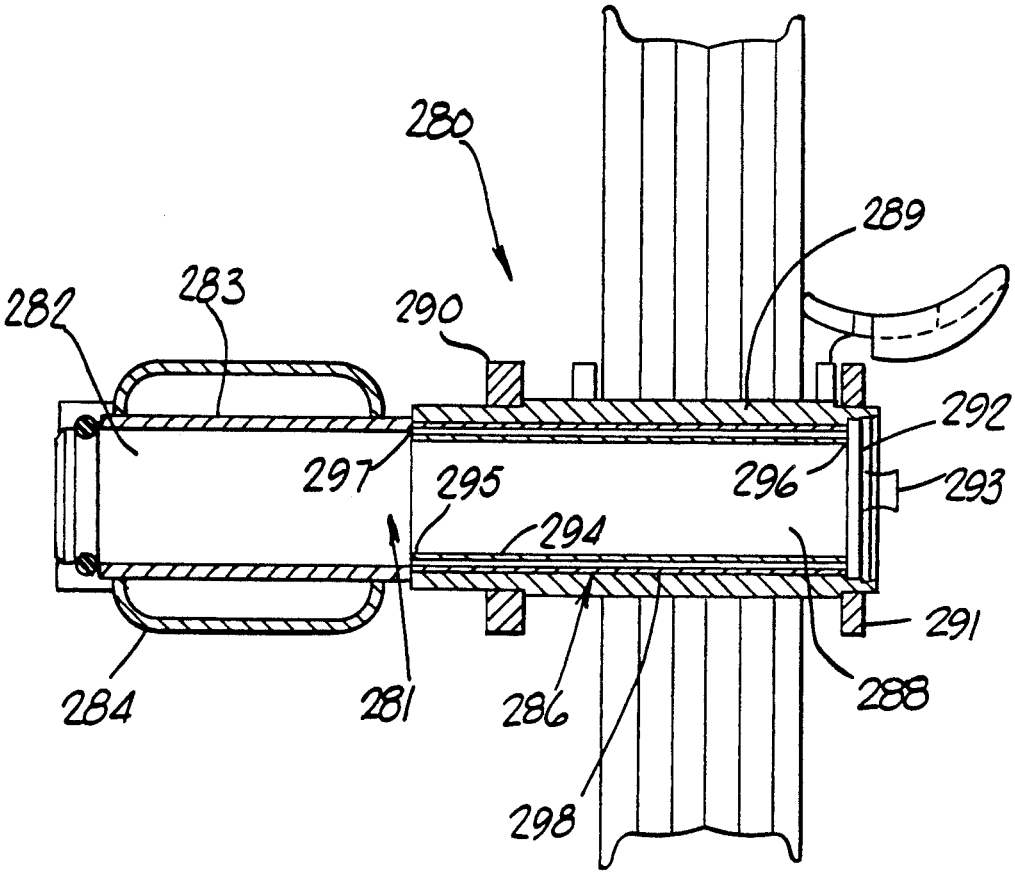
FIG. 6 shows an intermediate rocker arm hub assembly.

FIG. 6 shows an intermediate rocker arm hub assembly 280 comprising a shaft member 281 with an enlarged diameter end portion 282 mounted in a sleeve member 283 in the main rocker arm member 284. A resilient bushing unit 286 is mounted on reduced diameter shaft end portion 288 and supports a sleeve member 289 extending between and fixedly connected to side plate members 290, 291. A retainer plate member 292 and suitable bolt devices 293 hold the assembly on the shaft member 281. Bushing unit 286 has an inner sleeve member 294 with opposite end portions 295, 296 fixedly abuttingly engaged with a shaft shoulder portion 297 and plate 292. Outer sleeve member 298 is fixedly mounted in member 289 and is resiliently movably supported by the intermediate elastomeric member 299 as previously described.

Figure 7:
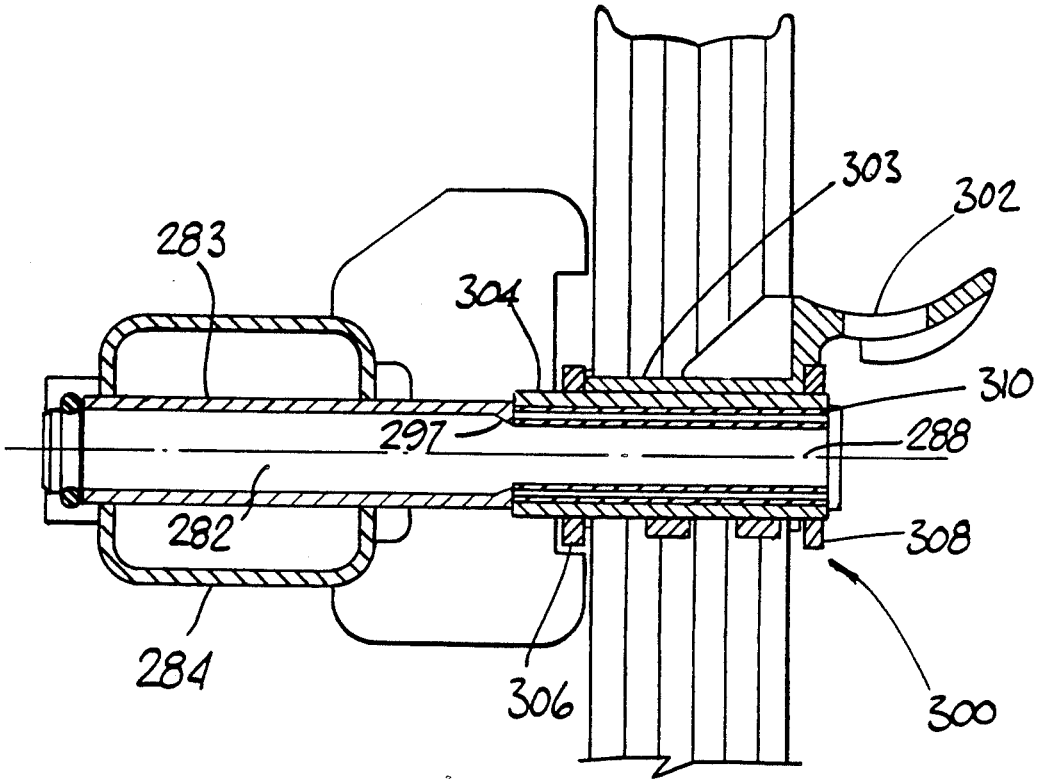
FIG. 7 shows another intermediate rocker arm hub assembly.

FIG. 7 shows an intermediate rocker arm hub assembly 300 including a cable derail catch device 302 having a hub portion 303 fixed to an outer sleeve member 304 connected to rocker arm plate members 306, 308. The construction and arrangement is otherwise similar to that of FIG. 6 with a bushing unit 310 mounted on shaft portion 288.

Figure 8:
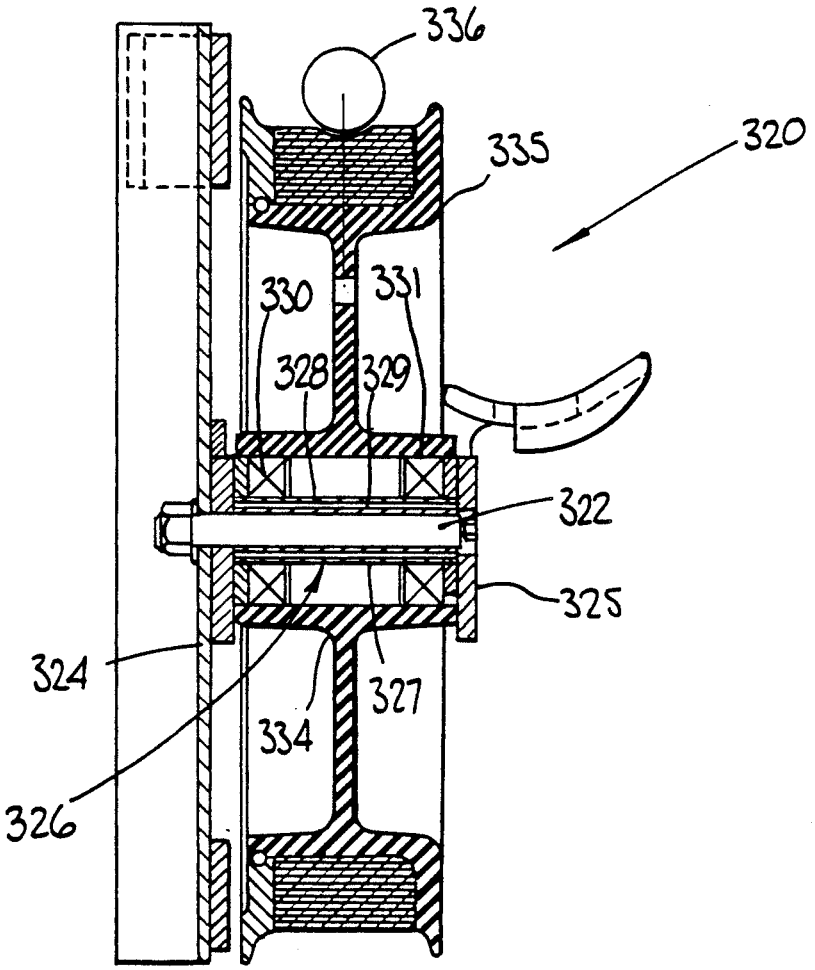
FIG. 8 shows a sheave hub assembly.
Figure 8A:
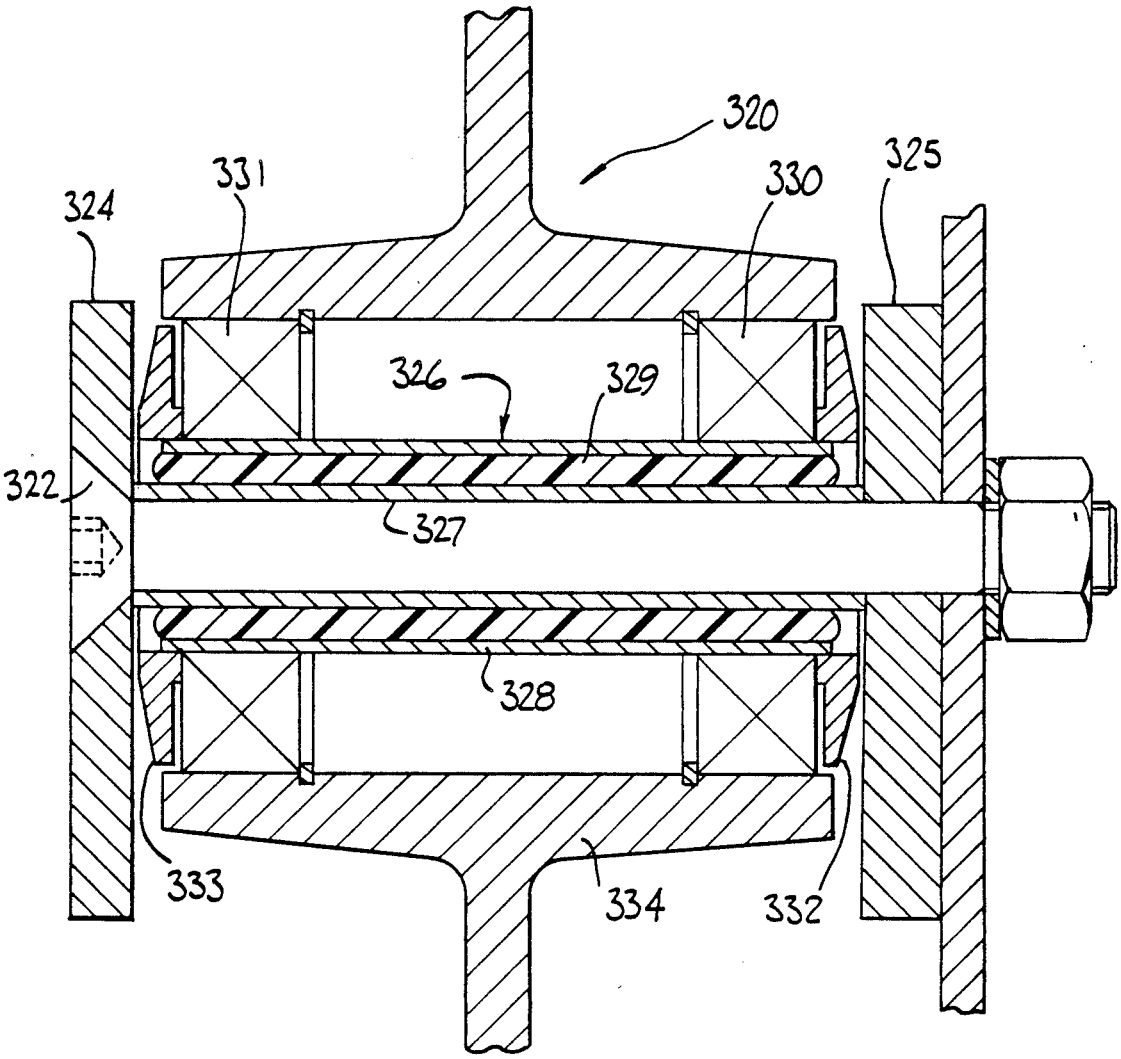
FIG. 8A shows a cross-sectional view of a sheave hub assembly.

FIGS. 8 and 8A show a sheave hub assembly 320 comprising a bolt member 322 extending between and fixedly connected to side plate members 324, 325 of a sheave rocker arm. A resilient coupling bushing means 326 is mounted on the bolt member and extends between the plate members 324, 325. Bushing means 326 comprises an inner sleeve member 327, an outer sleeve member 328, and an elastomeric intermediate connecting member 329. The inner sleeve member 327 is fixedly clamped between the plate members 324, 325 by the bolt member. Bearing units 330, 331 are mounted on the outer sleeve member 328 of the bushing means by washer members 332, 333 and rotatably support hub portion 334 of the sheave 335 which is of conventional construction and engages a cable 336. In this case, the bushing means 326 serves as a sound and vibration dampening means which isolates the sheave and the bearings from the support shaft provided by the bolt member 322.

In general, during assembly, the bushing unit is press-fitted into the hub member so that outer sleeve member is fixed relative thereto. In the embodiments of FIGS. 4 and 5A, an abutment collar member is mounted on the shaft shoulder in fixed abutting engagement with the inner end portion of inner sleeve member which slides over the shaft end portion. In the embodiments of FIGS. 6 and 7, the inner sleeve member abuts a shoulder on the shaft. In the embodiments of FIGS. 5B and 8A, the inner sleeve abuts the side surfaces of the place members. In the embodiments of FIGS. 4, 5A and 6, an end plate member is bolted onto the shaft and is held in fixed abutting engagement with the outer end portion of inner sleeve member by the bolt members. The collar member and the plate member are held in axially spaced relationship from the adjacent end portions of the elastomeric member, the outer sleeve member and the hub member.

It is contemplated that the inventive concepts herein described may be variously otherwise embodied and it is intended that the appended claims be construed to include the alternative embodiments of the invention except insofar a limited by the prior art.

What is claimed is:

1. A sheave support system for supporting the sheaves of a multiple sheave assembly relative to a support structure such as a ski lift tower and comprising:

at least two sheave means rotatable mounted on the sheave assembly in spaced parallel relationship for supporting the ski lift cable;

at least one main support shaft means for movably supporting the sheave assembly relative to the ski lift tower;

at least two intermediate support arm means mounted on said main support shaft means;

at least two intermediate support shaft means mounted on opposite ends of said intermediate support arm means for rotatably supporting said sheave means;

each of said support shaft means comprising a support shaft, a hub member mounted circumjacent said support shaft, and an elastic bushing means mounted between and circumjacent said support shaft and said hub member for connecting said hub member to said shaft member while enabling limited relative rotative movement therebetween of less than approximately 15° and also limiting transmission of vibration therebetween.

2. The invention as defined in claim 1 and wherein said elastic bushing means comprises:

a rigid metallic inner sleeve member;

a rigid metallic outer sleeve member; and elastomer intermediate resilient connecting means mounted between said inner sleeve member and said outer sleeve member for enabling resilient relative movement therebetween.

3. The invention as defined in claim 2 and wherein:

said inner rigid metallic sleeve member being fixed and non-rotatably supported relative to said shaft member; and said outer rigid sleeve member being fixed and non-rotatably supported relative to said hub member.

4. Apparatus for supporting and connecting a support shaft member to a hub member mounted circumjacent thereto, in a sheave assembly comprising:

a rigid, metallic inner sleeve member fixedly non-rotatably mounted relative to said support shaft member;

a rigid metallic outer sleeve member fixedly non-rotatably mounted relative to said hub member;

an elastomeric resilient intermediate non-metallic connecting means mounted between and circumjacent to said inner sleeve member and said outer sleeve member and being fixedly connected to each for enabling limited relative resilient rotative displacement therebetween;

spaced side plate members wherein:

said shaft members extends between said side plate members;

said inner sleeve member having opposite end portions in fixed abutting engagement with said side plate members; and said outer sleeve member being rotatably displaceable relative to said side plate members.

5. The invention as defined in claim 3 and further comprising:

spaced side plate members;

said shaft member extending between said side plate members;

said inner sleeve member having opposite end portions in fixed abutting engagement with said side plate members; and said outer sleeve member being rotatably displaceable relative to said side plate members.

6. The invention as defined in claim 5 and wherein:

said inner sleeve member having a length greater than the length of said outer sleeve member whereby said inner sleeve portion has end portions extending axially outwardly beyond the end portion of said outer sleeve member.

7. The invention as defined in claim 6 and wherein:

said shaft member having abutment means thereon for abuttingly fixedly engaging one end portion of said inner sleeve member.

8. The invention as defined in claim 7 and wherein said abutment means comprising:

a shoulder portion on said shaft between a mounting portion and a reduced diameter end portion.

9. The invention as defined in claim 7 and wherein said abutment means comprising:

a collar means mounted on said shaft member for providing an abutment surface engageable with said end portion of said inner sleeve member.

10. A sheave train assembly for a cable operated transportation system and comprising:

at least four sheave units for engaging the cable;

at least two sheave support rocker arm units for supporting said sheave units;

at least one intermediate rocker arm unit for pivotally supporting said sheave support rocker arm units;

each sheave support rocker arm unit having a central pivot means for enabling pivotal movement of said sheave support rocker arm means about a central axis and having sheave support shaft means at opposite ends of said sheave support rocker arm means for rotatably supporting an associated sheave unit;

each intermediate rocker arm unit having a central pivot means for enabling pivotal movement thereof and having rocker arm support shaft means at opposite ends thereof for pivotally supporting an associated sheave supporting rocker arm means;

shaft and hub pivot means centrally, located on each sheave support rocker arm means for enabling pivotal rocking movement of each sheave support rocker arm means;

axle means located on each end of each of said sheave support rocker arm means for rotatably supporting an associated sheave means;

an axle (shaft) means for pivotally supporting said rocker arm means enabling limited angular displacement of said rocker arm means;

a hub means centrally located on said rocker arm means for providing a central pivotal axis enabling pivotal movement of said rocker arm means; and an elastomeric bushing means between and in circumjacent relationship to said axle means and said hub means for coupling said axle means to said axle means and enabling limited relative opposite rotational movement between said axle means and said hub means and for reducing transmission of vibration therebetween and for reducing operational noise.

11. The invention as defined in claim 10 and wherein said elastomeric bushing means comprising:

an inner rigid metallic cylindrical sleeve member mounted circumjacent said axle means;

an intermediate cylindrical layer of elastomeric material mounted on and circumjacent to said inner rigid metallic cylindrical sleeve member; and an outer rigid metallic cylindrical sleeve member mounted on and circumjacent to said intermediate cylindrical layer of elastomeric material.

12. The invention as defined in claim 11 and wherein:

said outer rigid metallic cylindrical sleeve member being press-fitted within said hub means and being non-movably retained therein within the elastomeric limit of said cylindrical layer of elastomeric material; and said inner rigid metallic cylindrical sleeve member being fixedly mounted relative to said outer rigid metallic sleeve member.

13. Apparatus for supporting and connecting a support shaft member to a hub member mounted circumjacent thereto comprising:

a rigid, metallic inner sleeve member fixedly non-rotatably mounted relative to said support shaft member;

a rigid metallic outer sleeve member fixedly non-rotatably mounting relative to said hub member;

an elastomeric resilient intermediate connecting means mounted between said inner sleeve member and said outer sleeve member and being fixedly connected to each for enabling limited relative resilient rotative displacement therebetween;

spaced side plate members;

said shaft member extending between said side plate members;

said inner sleeve member having opposite end portions in fixed abutting engagement with said side plate members;

said outer sleeve member being limitedly rotatably displaceable relative to said side plate members; and said inner sleeve member having a length greater than the length of said outer sleeve member whereby said inner sleeve portion has end portions extending axially outwardly beyond the end portion of said outer sleeve member.

14. The invention as defined in claim 13 and wherein:

said shaft member having abutment means thereon for abuttingly fixedly engaging one end portion of said inner sleeve member.

15. The invention as defined in claim 14 and wherein said abutment means comprising:

a shoulder portion on said shaft between a mounting portion and a reduced diameter end portion.

16. The invention as defined in claim 14 and wherein said abutment means comprising:

a collar means mounted on said shaft member for providing an abutment surface engageable with said end portion of said inner sleeve member.

* * * * *